United States Patent [19]

Aparicio, Jr. et al.

[11] 4,432,256

[45] Feb. 21, 1984

[54] ADJUSTABLE POWERED WRENCH

[75] Inventors: Thomas Aparicio, Jr., Houston, Tex.; Ron Graham, Norco, Calif.

[73] Assignee: Gratec, Inc., Norco, Calif.

[21] Appl. No.: 305,934

[22] Filed: Sep. 28, 1981

[51] Int. Cl.[3] ..... B25B 13/46

[52] U.S. Cl. ..... 81/57.39

[58] Field of Search ..... 81/57.39

[56] References Cited

U.S. PATENT DOCUMENTS

| | | | |
|---|---|---|---|
| 4,091,890 | 5/1978 | Wilmeth et al. | 81/57.39 |
| 4,132,136 | 1/1979 | Wilmeth | 81/57.39 |
| 4,200,011 | 4/1980 | Wilmeth | 81/57.39 |
| 4,308,767 | 1/1982 | Wilmeth | 81/57.39 |

*Primary Examiner*—James L. Jones, Jr.
*Attorney, Agent, or Firm*—Neal J. Mosely

[57] ABSTRACT

An adjustable powered wrench for turning threaded members consists of a wrench adapted to be positioned over a threaded member, viz. nut or bolt, for applying a torque for tightening or loosening the same. The wrench has an operating arm for transmission of power, preferably having a head with teeth forming an arcuate rack. A fluid operated cylinder has an operating piston extending therefrom which is operatively connected to a pawl with teeth which mate with the rack teeth on the head of the wrench operating arm. A first reaction arm is provided having one end with a pivotal connection thereon, e.g. ring, adapted to fit over one of the threaded members for support and having an opposite end pivotally connected to the cylinder for supporting the same. An adjustable anchor member consists of a second reaction arm having one end with a pivotal connection, e.g. ring, adapted to fit over another one of said threaded members for support. An adjustable sleeve member is slidably positioned on the second reaction arm which includes means for selectively positioning the same in different positions along the length thereof. The ring member is pivotally connected to the first reaction arm so that adjustment of the ring member is operable to adjust the position of the first reaction arm and the fluid operated cylinder relative to the wrench and to adjust for different bolt patterns.

8 Claims, 3 Drawing Figures

ADJUSTABLE POWERED WRENCH

BACKGROUND OF THE INVENTION

1. FIELD OF THE INVENTION

This invention relates to new and useful improvements in power wrenches and more particularly to an adjustably positioned power wrench.

2. BRIEF DESCRIPTION OF THE PRIOR ART

Power wrenches for threaded members, such as nuts and bolts are described in a variety of patents extending over a period of 20 years or more.

Calhoun U.S. Pat. No. 2,544,639 discloses hydraulically operated tongs for use in drilling.

Huff U.S. Pat. No. 2,972,918 discloses a hydraulically operated wrench and special supporting arrangement for use in fastening and unfastening large size nuts used on head closures for heaters and exchangers.

Franck U.S. Pat. No. 3,198,040 discloses a hydraulically operated wrench used in making up fittings, such as couplings.

Wilmeth U.S. Pat. No. 3,706,244 discloses another type of hydraulic wrench used for tightening or loosening bolts or nuts on large pieces of flanged equipment.

Keller U.S. Pat. No. 3,930,776 discloses a hydraulic wrench having a novel ratchet arrangement therein, Junker U.S. Pat. No. 4,027,561 discloses another type of hydraulically operated wrench having a ratchet arrangement for driving the wrench.

Wilmeth U.S. Pat. Nos. 4,091,890 and 4,200,011 disclose still another type of ratchet arrangement in a hydraulically operated wrench.

Parker U.S. Pat. No. 4,027,560 discloses hydraulic wrench having an adapter for varying the point of application of force to the lateral arm of the wrench.

SUMMARY OF THE INVENTION

One of the objects of this invention is to provide an improved fluid operated wrench which can be set in a selected position during operation.

Another object of the invention is to provide an improved fluid operated wrench having an adjustable support for varying the position of a fluid operated cylinder relative to the operating arm of the wrench.

Still another object of this invention is to provide an improved fluid operated wrench having a rack and pawl type drive and including an improved means for varying the position of a fluid operated cylinder relative to the wrench.

Yet another object of the invention is to provide a fluid operated wrench assembly having replaceable supporting rings and wrench heads for use with varying sizes of bolt heads or nuts.

Other objects of this invention will become apparent from time to time throughout the specification and claims hereinafter related.

These and other objects of the invention are accomplished by an adjustable powered wrench for turning threaded members which consists of a wrench adapted to be positioned over a threaded member, viz. nut or bolt, for applying a torque for tightening or loosening the same.

The wrench has an operating arm for transmission of power, preferably having a head with teeth forming an arcuate rack. A fluid operated cylinder has an operating piston extending therefrom which is operatively connected to a pawl with teeth mating with the rack teeth on the head of the wrench operating arm. A first reaction arm is provided having one end with a pivotal connection thereon, e.g. ring, adapted to fit over one of the threaded members for support and having an opposite end pivotally connected to the cylinder for supporting the same.

An adjustable anchor member consists of a second reaction arm having one end with a pivotal connection, e.g. ring, adapted to fit over another one of said threaded members for support. An adjustable sleeve member is slidably positioned on the second reaction arm which includes means for selectively positioning the same in different positions along the length thereof.

The ring member is pivotally connected to the first reaction arm so that adjustment of the ring member is operable to adjust the position of the first reaction arm and the fluid operated cylinder relative to the wrench.

DESCRIPTION OF THE PREFERRED EMBODIMENT

Figure 1:
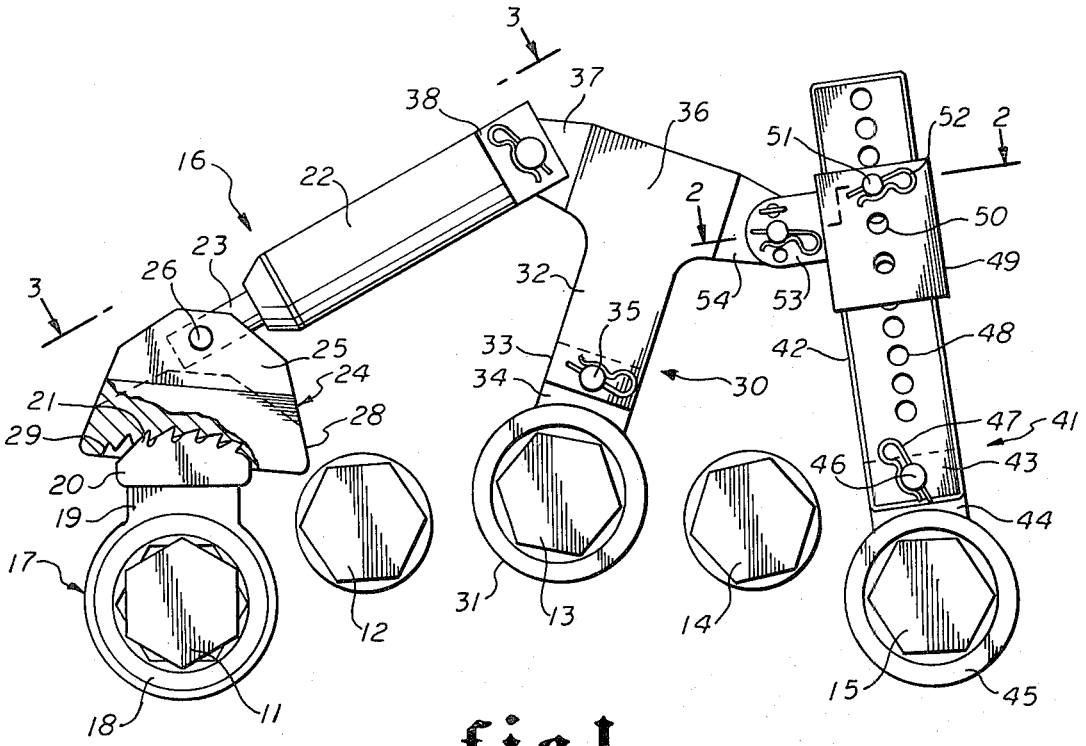
FIG. 1 is a view in elevation and partly in broken section of a fluid operated wrench assembly representing a preferred embodiment of this invention.

Referring to FIG. 1, there are shown a plurality of hexagonal nuts (or bolt heads) 11, 12, 13, 14 and 15. These nuts are shown as being positioned in a circular pattern and are typical of the nuts or bolts holding the flanges of a heat exchanger or a pressure vessel together. The arrangement is also typical of the nuts or bolts holding together the flanges of a blow up preventer. The nuts (or bolts) 11–15 may be a large size and require a very substantial force for tightening and loosening. Consequently, power equipment, in the form of hydraulic (or other fluid) fluid operated tools, has been developed for carrying out these operations. As will be noted from the prior art discussed above, there is need for power tools or wrenches which can be adjusted in position to take care of irregularities in the bolt or nut patterns which are being tightened or loosened.

In FIG. 1, this invention consists of a multipart fluid operated wrench assembly 16 which is shown positioned on several of the nuts (or bolts) in preparation for operation in loosening such nuts (or bolts). It can also be used for tightening bolts or nuts. Power operated wrench assembly 16 is described as a fluid operated wrench. This is preferably a hydraulically operated wrench but other types of operating fluids, including compressed gases, could be used for power.

In the wrench assembly 16, there is provided a separate wrench member 17 having a box wrench portion 18 and an operating arm 19 which terminates in a head 20 having a plurality of teeth 21 cut therein forming an arcuate rack. Box wrench portion 18 is shown in position fitted snugly around the hex nut (or hex headed bolt) 11.

Wrench portion 17 is arranged for actuation by fluid (hydraulic fluid or compressed gas) cylinder 22 having operating piston 23 extending therefrom. Cylinder 22 is preferably a double acting cylinder so that powered movement of piston 23 may be effected in both directions. A driving pawl 24 is provided to transmit power between piston 23 and wrench 17. Pawl 24 has a slotted clevis portion 25 which receives the end of piston 23. Clevis portion 25 is apertured as is the end of piston 23 and the apertures receive a removable pin 26 which secures these members together in a pivotal operating relationship. Securing pin 26 is further secured against displacement by a cotter pin 27 or the like.

Driving pawl 24 is enlarged in width at its lower portion 28 and slotted to fit over the arcuate rack teeth 21 on head 20 of wrench 17. The internally slotted portion 28 of pawl 24 is provided with an arcuate portion having teeth 29 cooperable with the teeth 21. In the position shown the teeth 21 are pointed to the right and the teeth 29 are pointed to the left so that these teeth engage in a driving relationship. Pawl 24 is therefore operable in this position to drive head portion 20 and operating arm 19 of wrench 17 to the left upon outward movement of piston 23 by fluid pressure in cylinder 22. As will be subsequently described, the wrench 17 and pawl 24 may be reversed so that retractive movement of piston 23 may be used to turn wrench 17 in the opposite direction.

On nut (or bolt head) 13, there is positioned a pivotally mounted two-part reaction arm 30. This reaction arm has a pivotal supporting ring portion 31 which is connected to a T-shaped reaction arm 32. The base of the stem portion 33 of T-shaped reaction arm 32 is connected to arm 34 of ring 31 by means of a tongue and clevis joint secured together by pin 35. It is immaterial which of the members 31 or 32 has the tongue or the clevis. The upper end of the reaction arm 30 consists of the cross bar portion 36. One end of this portion comprises a tongue 37 which fits a clevis portion 38 on cylinder 22. Tongue 37 and clevis 38 are secured together by pin 39 which is further secured against displacement by means of a cotter pin 40.

Figure 2:
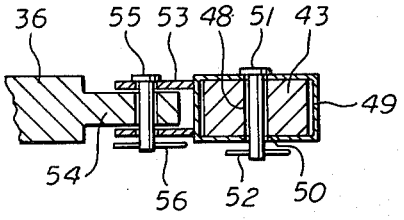
FIG. 2 is a sectional view taken on the line 2—2 of FIG. 1.
Figure 3:
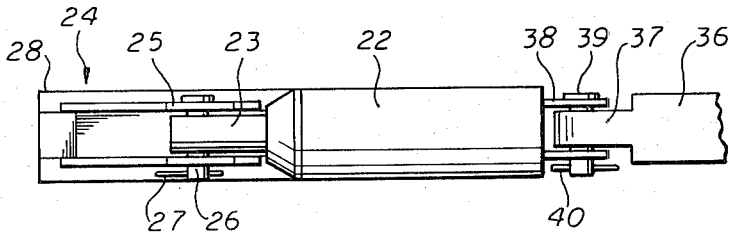
FIG. 3 is a plan view looking from the line 3—3 of FIG. 1 showing the connection between the wrench, piston and positioning arm.

On hex nut (or bolt head) 15 there is shown an adjustable reaction arm 41 for regulating the position of arm 30 and thus locating accurately the position of cylinder 22 in relation to wrench 17. Adjustable arm 41 is a two-part structure consisting of arm 42 which is connected by a tongue and clevis connection 43 to side arm 44 on a supporting ring 45. The tongue and clevis connection is secured by pin 46 secured in place by cotter pin 47. Supporting arm 42 is preferably rectangular in cross section as seen in FIG. 2.

Adjustable reaction arm 42 has a plurality of equally spaced holes 48 therein. A ring 49 is slidably positioned on arm 42. Sleeve 49 has a plurality of holes 50 therein which are spaced on a different spacing from the holes 48 in arm 42. The holes in arm 42 may be spaced $\frac{3}{4}\Delta$ and the holes on sleeve 49 spaced $\frac{3}{4}''$ and $\frac{1}{2}''$. This difference in spacing permits a Vernier type adjustment in the location of sleeve 49 on arm 42. Sleeve 49 is located by pin 51 extending through a aligned holes 50 and 48. Pin 51 is secured against displacement by cotter pin 52.

Sleeve 49 has a clevis portion 53 into which fits a tongue portion 54 on the cross bar 36 of reaction arm 32. This tongue and clevis joint is secured together by pin 55 which is retained in place by cotter pin 56.

OPERATION AND USE

The power wrench assembly described above is normally produced and shipped in a disassembled state. Box wrench 17 (open end wrenches or other types could be used for light loads) is provided in a variety of sizes for use with nuts or bolts of varying sizes. Likewise, ring members 31 and 45 are provided in a variety of sizes to fit the various nuts (or bolt heads) on which they are to be assembled.

In FIG. 1, the wrench assembly 16 is shown installed and ready for operation in a direction for loosening the nut (or bolt) 11. Box wrench 17 is placed over nut (or bolt head) 11. The adjustable anchor arm 30 is positioned over nut (or bolt head) 13 for pivotal or rotary movement thereon during initial adjustment. Fluid operated piston 22 is secured on tongue member 37 of anchor arm 32. The toothed pawl 24 is secured on operating piston 23 by pin 26 with the teeth 21 and 29 in engagement.

Reaction arm 41 is positioned with ring 45 located over nut (or bolt head) 15 for rotary or pivotal movement thereon during initial adjustment. Sleeve member 49 is secured to tongue member 54 of operating arm 32. Sleeve member 49 is adjusted to locate piston 22 at the optimum angle for application of thrust to box wrench 17. As noted above, a very fine adjustment of sleeve member 49 on arm 42 is possible because of the spacing of the holes 48 and 50. When sleeve member 49 is positioned properly, pin 51, and securing cotter pin 52, are positioned as shown to secure sleeve member in place.

In this configuration, the structure is rigidly assembled. When piston 22 is operated by application of hydraulic fluid (or compressed gas), piston 23 moves out to force pawl 24 to rotate box wrench 17 in a counterclockwise direction. After a maximum amount of rotary movement of wrench 17 has been accomplished by extension of piston 23, the piston is retracted and pawl 24 is repositioned. After further movement, it is necessary to reposition the box wrench 17. It is generally necessary for all of the teeth of rack 20 to be engaged by teeth of pawl 24 for effective application of force.

When it is desired to use the wrench assembly for rotating box wrench 17 in a clockwise direction, the entire assembly can be reversed. In this arrangement, cylinder 22 would extend to the left of box wrench 17 and the reaction arms 30 and 41 would have their supporting rings 31 and 45 positioned on nuts (or bolt heads) to the left of nut 11.

Alternatively, if there is not space to the left of nut 11 for the fluid operating cylinder 22 and the adjustment arms 30 and 41, the apparatus can be positioned as shown in FIG. 1 and only the pawl 24 and wrench 17 reversed in position. In this case, pin 26 is removed and pawl 24 is reversed and pin 26 replaced in position. Likewise, wrench 17 is turned over so that teeth 21 fit into teeth 29. In this arrangement, the double acting piston 22 has fluid pressure applied to retract piston 23 under power. This retraction of piston 23 causes pawl 24 to pull on the rack teeth 21 of head 20 to rotate box wrench 17 in a clockwise direction.

While this invention has been described fully and completely with special emphasis upon a single preferred embodiment, it should be understood that within the scope of the appended claims the invention may be practiced otherwise than as specifically shown and described herein.

We claim:

1. An adjustable powered wrench for turning threaded members comprises a wrench member adapted to be positioned over a threaded member for applying a torque thereto and having an operating arm for transmission of power, a fluid operated cylinder and operating piston extending therefrom, said piston being operatively connected to said wrench operating arm, a first reaction arm having one end with a pivotal connection thereon adapted to fit over one of said threaded members for support thereon, and having an opposite end pivotally connected to said cylinder for supporting the same, said first reaction arm being T-shaped including a cylindrical ring at the base thereof providing said pivotal connection to one of said threaded members and having a clevis or tongue member being positioned at opposite ends of the cross arm thereof, said first reaction arm being removably connected to said cylindrical ring for servicing, one part having a clevis and the other a tongue member, and including a removable pin securing the connection together, an adjustable anchor member comprising a second reaction arm having one end with a pivotal connection thereon adapted to fit over another one of said threaded members for support thereon, said second reaction arm having a cylindrical ring at one end providing said pivotal connection to one of said threaded members, said second reaction arm being removably connected to said cylindrical ring for servicing, one part having a clevis and the other a tongue member, and including a removable pin securing the connection together, an adjustable sleeve member slidably positioned on said second reaction arm and including means for selectively positioning the same in different positions along the length thereof, means pivotally connecting said sleeve member to said first reaction arm, whereby adjustment of said sleeve member is operable to adjust the position of said first reaction arm and said fluid operated cylinder relative to said wrench, said pivoted connection of said first reaction arm to said cylinder comprising said clevis on one and said tongue member on the other and a removable pin securing the same together for pivotal movement, and said pivoted connection of said first reaction arm to said sleeve comprises a clevis on one and a tongue member on the other and a removable pin securing the same together for pivotal movement.

2. An adjustable wrench according to claim 1 in which said operative piston to wrench connection comprises a head on said wrench operating arm having an arcuate toothed rack thereon, a driving pawl having an arcuate toothed configuration cooperable with said rack for moving the same to turn said wrench, and said piston being pivotally connected to said pawl.

3. An adjustable wrench according to claim 2 in which said cylinder is double acting, and said rack and said pawl are reversible to provide for tightening or loosening said threaded member.

4. An adjustable wrench according to claim 2 in which said pawl has a clevis portion in which said piston is secured by a removable pin.

5. An adjustable wrench according to claim 1 in which said second reaction arm has a plurality of equally spaced holes along the length thereof, said sleeve has a plurality of holes alignable with selected holes on said second reaction arm, and a pin is positioned in said sleeve and supporting arm holes to adjustably position said sleeve in a selected position.

6. An adjustable wrench according to claim 5 in which said holes on said sleeve are spaced at different intervals from the holes on said second reaction arm to provide a vernier-type adjustment for said sleeve thereon.

7. An adjustable wrench according to claim 6 in which said second reaction arm and said sleeve are of substantially rectangular cross section.

8. An adjustable wrench according to claim 1 in which there are a plurality of said wrench members of different sizes, and said pivotal connections of said first and said second reaction arms have a plurality of different sizes corresponding in size to each different size of wrench member.

* * * * *